United States Patent [19]

Simmons et al.

[11] 4,052,939

[45] Oct. 11, 1977

[54] TAMPABLE CHUB CARTRIDGE

[75] Inventors: Walter John Simmons, Martinsburg; Frank Marsden Willis, Hedgesville, both of W. Va.

[73] Assignee: E. I. Du Pont de Nemours and Company, Wilmington, Del.

[21] Appl. No.: 672,726

[22] Filed: Apr. 1, 1976

[51] Int. Cl.[2] ..... F42B 3/00

[52] U.S. Cl. ..... 102/24 R; 86/20 R

[58] Field of Search ..... 102/24; 86/1 R, 20 R; 428/910

[56] References Cited

U.S. PATENT DOCUMENTS

| | | | |
|---|---|---|---|
| 3,322,613 | 5/1967 | Rasmussen | 428/910 |
| 3,409,495 | 11/1968 | Rasmussen | 428/910 |
| 3,471,353 | 10/1969 | Rasmussen | 428/910 |
| 3,837,279 | 9/1974 | Cooke, Jr. | 102/24 |
| 3,921,529 | 11/1975 | McKee | 102/24 |

*Primary Examiner*—Verlin R. Pendegrass

[57] ABSTRACT

A chub cartridge containing a water-bearing blasting agent and having a film wrap of a cross-laminate of oriented film layers has at least one unlaminated zone in the film wrap in the longitudinal direction, or preferably is adapted to form a zone of multiple delaminations along said direction by virtue of scoring, the latter being the site of delamination when the cartridge has end-pressure applied to it with a tamping rod. The different layers fail in different directions along the unlaminated zone, affording a measure of integrity to the cartridge if roughly handled, as well as ease of rupture on tamping. The cartridge also has good abrasion and tear resistance, and dimensional stability.

13 Claims, 5 Drawing Figures

TAMPABLE CHUB CARTRIDGE

BACKGROUND OF THE INVENTION

1. Field of the Invention

This invention relates to an improved film-wrapped blasting cartridge, particularly a chub cartridge containing a water-bearing blasting agent.

2. Description of the Prior Art

Semi-solid colloidal dispersions of water-bearing blasting agents, e.g., water gels or slurry explosives or emulsion-type blasting agents, currently are available in the form of small-diameter, i.e., less than 1.75-inch (44.5-mm), cartridges for use in underground blasting operations. The cartridge, often referred to as a "chub" cartridge, is a tube of plastic film, filled with blasting agent, and gathered at both ends and closed, e.g., by means of metal closure bands around the gathered portions.

The film wrap of a chub cartridge has to have sufficient tear and abrasion resistance that the cartridge will not fail catastrophically when subjected to the force used to load it into a borehole, especially a rough or gravelly borehole. Also, the tear resistance of the film should be sufficient that a tear made in the film for insertion of a blasting cap in a primer cartridge will not propagate to a degree such as to cause the cartridge to fail, and a significant amount of the cartridge contents to escape, before the cartridge has been positioned in the borehole. The impact strength of the film wrap also has to be high enough to insure against failure of the cartridge and loss of its contents should it be subjected to rough handling conditions prior to loading. In addition, the film should have sufficient dimensional stability to prevent gross deformation of the cartridge and attendant loading difficulties, but preferably should not be so stiff that the rigid rounded cartridge ends cause the cartridges to override and jam during stringloading.

A still further requirement on the cartridge is that it be tampable, generally understood to mean that the cartridge should fail in the borehole when subjected to the steady hard push or impact of a tamping rod in a manner such that the blasting agent will be able to escape from the cartridge and fill the borehole more readily.

Heretofore, the wrapping film for chub cartridges has in most cases been polyethylene, polyethylene terephthalate, or a combination of the two. Polyethylene has such poor dimensional stability, however, that the cartridges are difficult to load into the borehole, and difficult to tamp as well. Polyethylene terephthalate cartridges have good dimensional stability and are tampable, but have poor tear and abrasion resistance and tend to override on string-loading. A laminated film of a layer of polyethylene terephthalate bonded on one or both of its sides to a layer of polyethylene combines the dimensional stability afforded by the terephthalate and the abrasion resistance afforded by the polyethylene.

U.S. Pat. No. 3,921,529, issued Nov. 25, 1975, to Canadian Industries Ltd., describes a stiff film-wrapped explosive cartridge in which the film consists of a stiffener (unpliable) layer, e.g., regenerated cellulose, cellulose acetate, polyester, paper, or polypropylene, bonded on one or both of its sides to a resilient, pliable film, e.g., polyethylene. The cartridge is adapted to expand circumferentially in a borehole upon application of end pressure with a tamping rod by virtue of one or more longitudinal areas of weakness in the stiffener layer, which is on the inside of the cartridge, preferably sandwiched between two layers of the pliable film. Rupture of the inner stiffener layer is said to permit further stretching of the outer pliable film allowing the circumferential expansion of the cartridge, thereby in effect converting the cartridge wrap to a dimensionally unstable all-polyethylene wrap. While this cartridge has dimensional stability during loading, as well as good abrasion resistance, the tear resistance of the cartridge when punctured by a blasting cap is inadequate. Furthermore, inasmuch as the circumferential expansion of the cartridge is apt to be followed by contraction when the end-pressure is removed, the possibility of achieving a filled borehole diameter with this cartridge is uncertain. Also, with respect to cartridge manufacturing techniques, the film wrap is continuously fed into a tube-forming device from a roll. Because cuts have to be made in the inner layer of the preferred three-layered laminate, the stiffener film has to be cut prior to the preparation of the laminate, and it is not possible to make adjustments in the location or depth of the cuts in the already prepared laminate to control package quality.

SUMMARY OF THE INVENTION

The present invention provides a blasting cartridge adapted to rupture in a borehole upon application of end pressure thereto with a tamping rod comprising a tube of plastic film gathered and closed at both ends and filled with a water-bearing blasting agent, the film comprising a cross-laminate of oriented film layers or plies of like composition and pliability, preferably a cross-laminate of two layers of oriented high-density polyolefin, and the cross-laminate having, or being adapted to form, at least one unlaminated zone along a major portion of the length, and preferably substantially parallel to the longitudinal axis, of the tube whereby the layers fail in different directions along the unlaminated zone and the cartridge ruptures upon the application of end pressure thereto in a borehole with a tamping rod.

In a preferred embodiment, either the inner or outer layer of a two-layered cross-laminate cartridge wrap has one or more longitudinal scored zones inclined to the direction of orientation of the adjacent, unscored layer, which zone(s) open up upon the application of end pressure to the cartridge while the unscored layer adjacent thereto debonds therefrom and fails at many places in the direction of its orientation. Thus, the cartridge ruptures with in situ delamination.

In another embodiment, a two-layered cross-laminate cartridge wrap has one or more longitudinal preformed unlaminated zones, each layer adjacent to an unlaminated zone failing parallel to the direction of its orientation, the direction beng different, e.g., by about 60° to 90°, for each layer.

The cross-laminate film wrap of the cartridge of the invention gives the cartridge dimensional stability and good abrasion and tear strength, while the unlaminated zone, or the cartridge's ability to form an unlaminated zone, makes the cartridge easy to tamp. The strength of the cross-laminate and the rupturability of the film on the application of tamping pressure result in a cartridge that withstands rough handling prior to and during loading into a borehole, withstands tear propagation when torn to receive a blasting cap, withstands gross deformation on loading, and ruptures readily (as contrasted to expansion) during tamping to permit the blasting agent to flow into the borehole, without the need for combining different wrapping materials, which may prove costly, and without necessitating the provision of weakness areas on an enclosed layer of the wrapper, which condition may interfere with effective quality control in the cartridging process.

BRIEF DESCRIPTION OF THE DRAWING

The blasting cartridge of the invention will be described with reference to the accompanying drawing in which.

DETAILED DESCRIPTION

Figure 1:
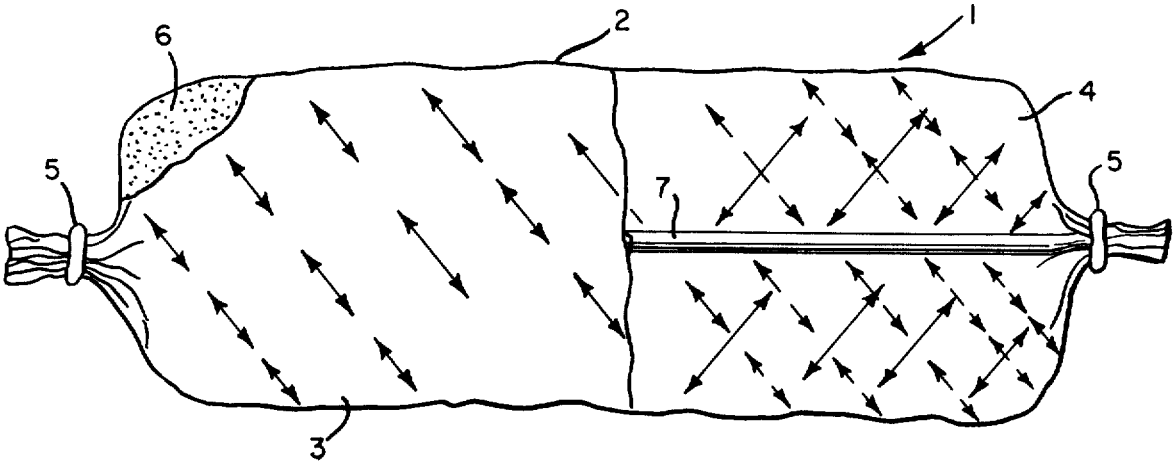
FIG. 1 is a partly cut-away view in elevation of a cartridge having a two-layered cross-laminate film wrap and a longitudinal pre-formed unlaminated zone in the cross-laminate.

The film wrap which forms the cartridge tube is a cross-laminate of layers of oriented film, preferably a polyolefin such as polyethylene or polypropylene. Especially preferred is a currently available cross-laminate of two oriented high-density polyethylene films. Such a laminate can be made, for example, by uniting oriented films by the methods described in U.S. Pat. Nos. 3,322,613, 3,471,353, and 3,496,059, the plies, which consist of uniaxially oriented films, having directions of orientation that are inclined to one another. The oriented film can be an obliquely oriented band made, for example, by the continuous method described in U.S. Pat. No. 2,943,356. The disclosures of U.S. Pat. Nos. 2,943,356, 3,322,613, 3,471,353, and 3,496,059 are incorporated herein by reference. In such cross-laminates, the angle between one orientation direction and the other is usually in the range of about from 60° to 90°.

The cross-laminate film wrap has one or more unlaminated zones extending along a major portion of the length of the cartridge tube, or preferably is adapted to form one or more zones of multiple delaminations, e.g., by indentation, cutting, scoring, perforating, etc. At an unlaminated zone, the layers fail in their different directions of orientation when end pressure is applied to the cartridge with a tamping rod, as will be described with reference to the drawing.

Figure 2:
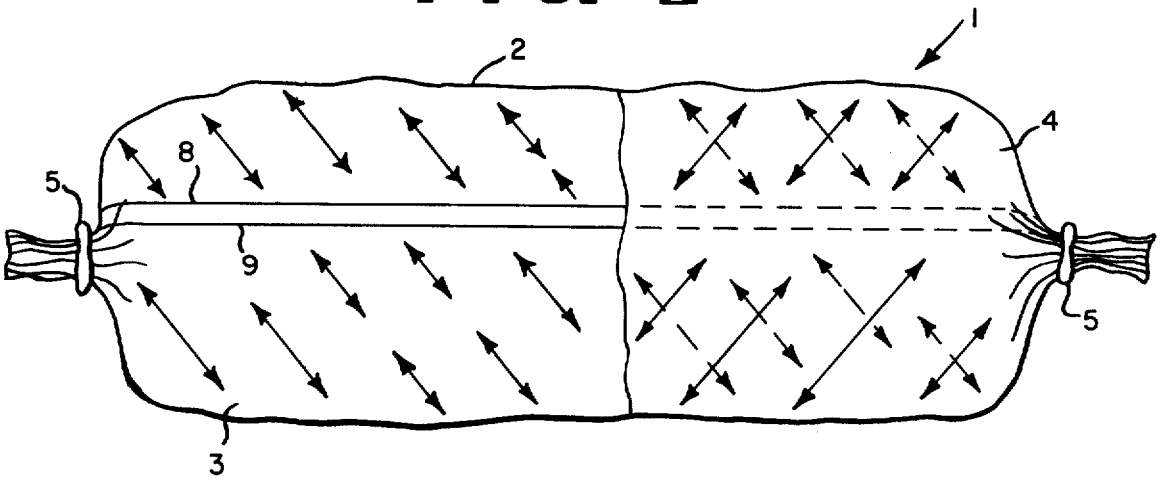
FIG. 2 is a partly cut-away view in elevation of a cartridge having a two-layered cross-laminate film wrap and two longitudinal cuts in the inner layer of the cross-laminate.

FIG. 2 shows a preferred tubular blasting cartridge of the invention wherein a longitudinal scored zone is provided in one layer of a two-layered cross-laminate film wrap inclined to the direction of orientation of the adjacent, unscored layer. In FIG. 2, a tubular blasting cartridge, denoted by the numeral 1, is comprised of a tube 2 of two-layered cross-laminate film, e.g., a cross-laminate of two oriented high-density polyethylene films, the molecular orientation (depicted by the arrows) of the inner film 3 being at an angle of 80° to that of the outer film 4. The film tube 2 is gathered and closed at both ends as shown, being secured by clips 5, and contains a water-bearing explosive composition 6, e.g., a cross-linked water gel explosive. The cross-laminate film is 0.004-inch (0.102-mm) thick, the cartridge diameter is 1.25 inches (31.75 mm), and the cartridge length is 12 inches (30.5 cm). The bond strength of the film, i.e., the force required to peel one layer from the other, is 250 grams per centimeter. Inner layer 3 has two substantially continuous scored zones 8 and 9 substantially parallel to the longitudinal axis of the cartridge tube and extending the entire length of the cartridge. Scored zones 8 and 9 are single, substantially continuous cuts which penetrate through layer 3 (i.e., are 0.002-inch (0.051-mm) deep), and are 0.031 inch (0.794 mm) apart. Scored zones 8 and 9 in layer 3 are inclined to the orientation direction of unscored layer 4 by 40°.

Figure 4:
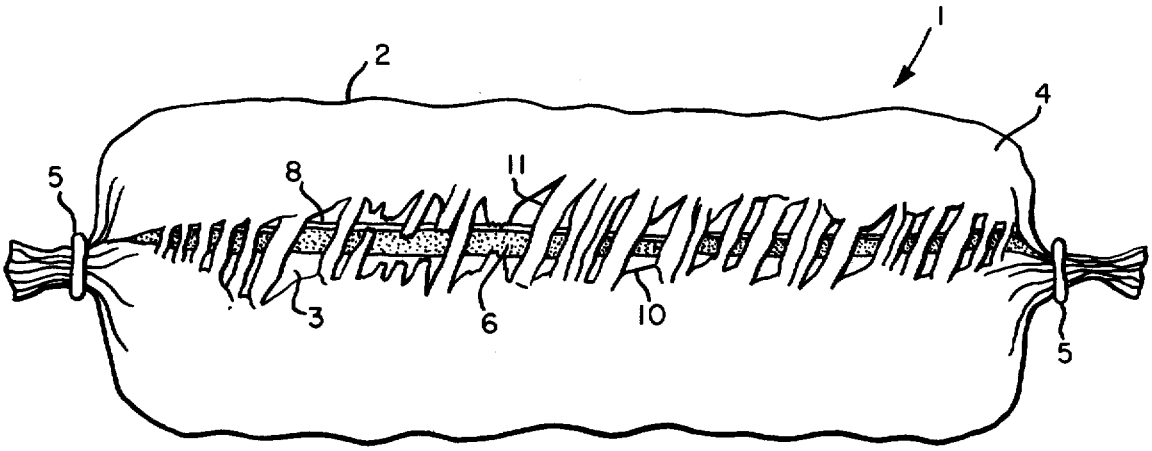

The unique mode of failure of the cartridge shown in FIG. 2 is shown in FIG. 4. Typically, when a hard steady push or impact is applied to the end of the cartridge, one of the scored zones, e.g., 9 in inner layer 3 opens up and gives rise to multiple unlaminated zones 11 as a result of the debonding of unscored layer 4 from layer 3 along scored zones 8 and 9. As is shown in FIG. 4, layer 4 fails (tears) and delamination occurs at multiple locations along scored zones 8 and 9, the direction of failure in layer 4 being in the direction of its orientation and therefore different than the direction of failure in layer 3 (parallel to the longitudinal axis). The explosive is ejected through apertures 10 produced at the multiple tears between the opened scored zone 9 and the shreds of layer 4.

The above-described mode of failure is useful from the point of view of affording a measure of cartridge integrity before the cartridge has been placed into a borehole, as well as cartridge rupturability when tamping pressure is applied. If the cartridge should be subjected to a fairly severe shock owing to rough handling prior to loading, numerous pinholes or apertures may form along the scored zone(s), but the water-bearing blasting agent, especially if its viscosity is moderately high, will not be lost. Gross cartridge rupture according to FIG. 4 and ejection of the blasting agent therefrom into the borehole occurs when the end-pressure exerted by a tamping pole pushes the blasting agent through the multiple apertures formed along the scored zones during tamping, or prior to tamping should such apertures form before loading owing to rough handling.

When the cartridge described above with reference to FIG. 2 is loaded into a 1.625-inch (41.23-mm)-diameter hole, an end-pressure comparable to that normally exerted with a tamping rod applied to the cartridge causes it to rupture and the blasting agent to spread into and be compacted in the hole, as is desired for a more effective utilization of explosive energy.

FIG. 1 also shows a tubular blasting cartridge 1 of the same size as that shown in FIG. 2 and comprised of a tube 2 of two-layered 0.003-inch (0.076 mm)-thick cross-laminate film having the same orientation of the film shown in FIG. 2. Films 3 and 4 are unlaminated in a 0.500-inch (12.7-mm)-wide zone 7, which is a tube-like zone running substantially parallel to the longitudinal axis of the cartridge tube (40° to the orientation of the films) and extending the entire length of the cartridge.

Figure 3:
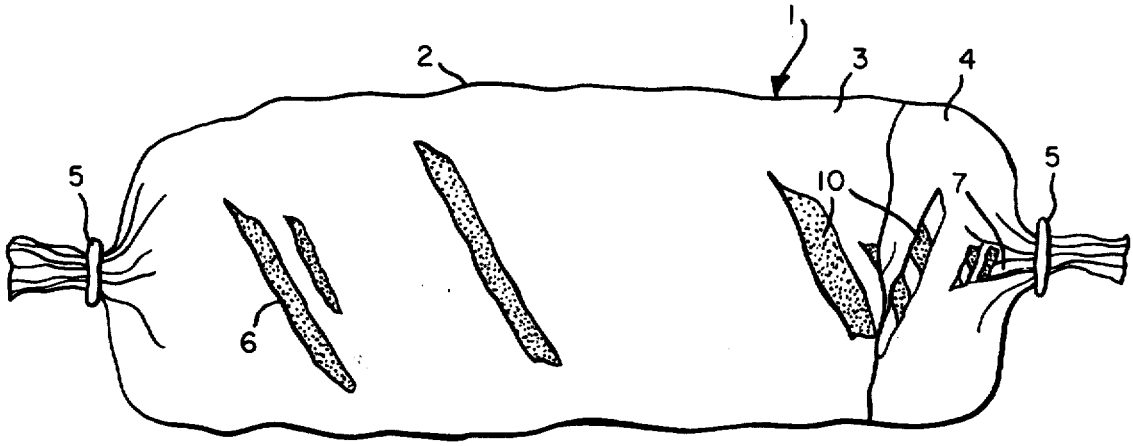
FIGS. 3 and 4 are views in elevation of the cartridges shown in FIGS. 1 and 2, respectively, upon the application of end pressure.

When tamping pressure is applied to the end of the cartridge shown in FIG. 1, layers 3 and 4 fail (tear) adjacent unlaminated zone 7, the number of failure sites depending on the width of zone 7, the thickness of the cross-laminate film, the magnitude of the force applied, etc. While layers 3 and 4 fail in different directions owing to their different directions of orientation, as a rule it appears that this cartridge typically fails at fewer sites along the length of the cartridge, as contrasted to the cartridge shown in FIG. 2. The mode of failure of the FIG. 1 cartridge in a typical case is depicted in FIG. 3. Application of tamping pressure to the end of this cartridge causes tearing of layers 3 and 4 at various locations along zone 7, in the direction of the layer's orientation. The pressure causes water gel explosive to be ejected from the cartridge through the apertures 10 produced at the overlapping tears in the film layers. Although this cartridge is tampable, and the number and size of the failure sites therein generally can be increased by widening the unlaminated zone or reducing the film thickness, this cartridge is less preferred than that shown in FIG. 2 because of the faster response of the latter cartridge to tamping pressure.

The unlaminated zone(s) (or delaminatable, e.g., scored, zones) in the present cartridge extend in the longitudinal direction of the cartridge, and can be straight or curved (e.g., spiral), continuous or discontinuous. Less complexity of film and cartridge processing conditions is associated with a cartridge that has its unlaminated, or delaminatable, zone(s) substantially continuous, substantially parallel to the longitudinal axis of the cartridge tube, and extending substantially the entire length of the cartridge. Therefore, such a cartridge is preferred. However, adequate tampability can be achieved if the unlaminated or delaminatable zone(s) are discontinuous and/or shorter than the cartridge provided that the total length of each such zone is greater than about one-half the length of the cartridge, and therefore cartridges having one or more such discontinuous or shorter zones fall within the purview of this invention.

Although the specific number of layers in the cross-laminate film is not critical, and three or more layers can be present, there is no need for more than two layers to achieve the properties required in a strong, tampable explosive cartridge. If, however, more than two layers are present in the cross-laminate, the interface between all pairs of adjacent layers therein should have, or be adapted to form, one or more unlaminated zones so that the cartridge will rupture on tamping. When scored zones are present, each layer of an adjacent pair of layers can have a scored zone therein, provided that such zones are offset from one another, e.g., by a distance equal to at least about 0.250 inch (6.35 mm). Preferably, however, only one of an adjacent pair of layers has a scored zone inasmuch as this condition provides satisfactory tampability while retaining the strength benefit of the orientation of the adjacent layer.

With the preferred scored layers, the innermost or outermost layer can be scored. For example, in the preferred two-layered cross-laminate, it is immaterial whether the inner or outer layer is scored, although one or the other may be preferred on the basis of ease of processing. The scored zone can be substantially a single longitudinal cut, preferably substantially continuous, or a zone of multiple cuts, e.g., short cuts inclined to the longitudinal axis of the cartridge. For example, a row of multiple intersecting cuts such as is produced with a knurling tool can be present.

The scoring can penetrate or cut through the entire depth of the layer, or merely form an indentation or slit through part of the thickness of the layer. For a given film bond strength, a deeper score results in a greater aptitude for delamination and failure. As a rule, the depth of the score will be about from 50 to 100 per cent of the layer thickness. Good results, in terms of strength and tampability, have been achieved with a 0.0040-inch (0.1016-mm)-thick film as described above in the description of the drawing with score depths of 0.0010–0.0020-inch (0.0254–0.0508-mm); and with the same film in a 0.003-inch (0.076-mm) thickness with score depths of 0.0007–0.0015-inch (0.0178–0.0381-mm). A score through the entire thickness of the layer is preferred for maximum response to tamping pressure.

With respect to pre-formed unlaminated zones, as was mentioned above, failure occurs more readily with a wider band of unlamination, a useful range being about from 0.500 inch (12.7 mm) to 0.750 inch (19.1 mm). The angles between the unlaminated zone and the orientation directions of the films are not critical. Thinner film, e.g., as low as about 0.003 inch (0.076 mm), is desirable with the pre-formed unlaminated zone.

One unlaminated, or delaminatable, zone in the cartridge is sufficient to provide the required tampability. However, especially in cases in which the film bond strength is high, it may be desirable to have two closely spaced scored zones in a layer, as shown in FIG. 2. Generally, such zones can be spaced apart by a distance of about from 0.015 inch (0.381 mm) to 0.125 inch (3.18 mm). More than two scored zones or more than one pre-formed unlaminated zone can be provided in the same layer, but usually will not offer much of an added advantage.

In the present cartridge, the combined properties of pre-loading cartridge integrity as well as cartridge rupturability on tamping are critically dependent on a difference in the orientation directions of the films in the laminate, i.e., on anisotropic strength properties, rather than on any absolute difference between the properties of one layer and those of another. For this reason, all of the layers in the laminate are of essentially the same composition and pliability.

Figure 5:
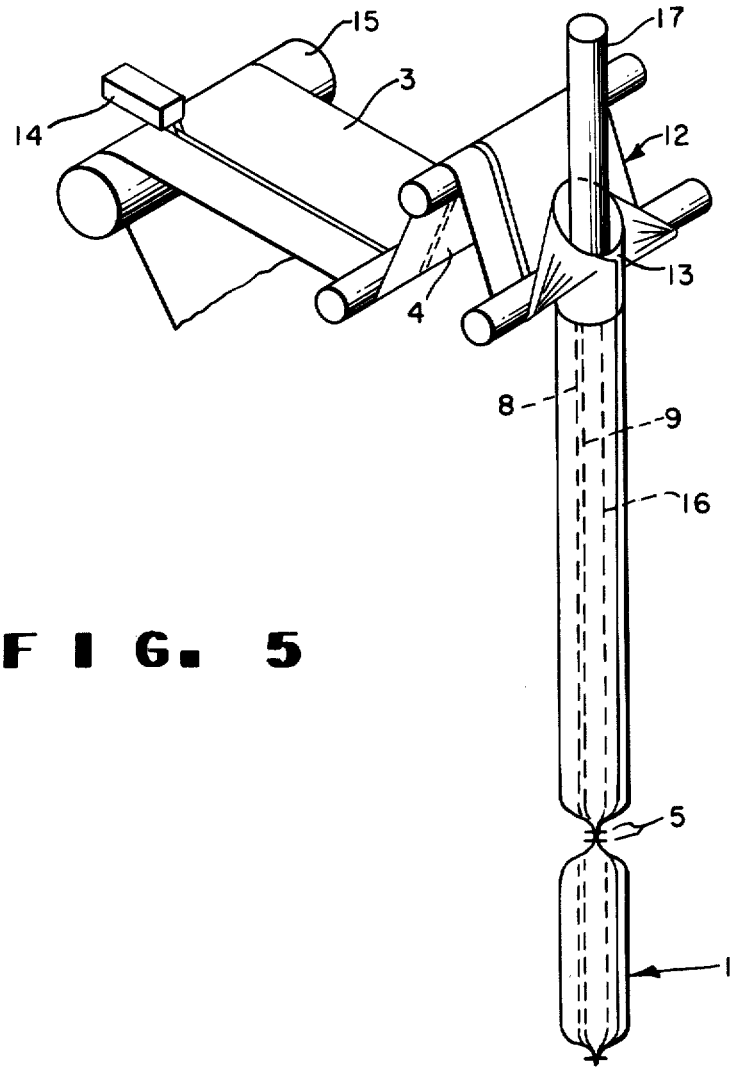
FIG. 5 is a schematic representation of a portion of a machine which can be used to make a series of cartridges like that shown in FIG. 2 in a continuous manner.

The explosive cartridge of the invention can be made in continuous fashion using packaging machinery such as that described in U.S. Pat. No. 2,831,302, issued Apr. 22, 1958, to Oscar Mayer and Co., the disclosure of which is incorporated herein by reference. To make a cartridge having an unlaminated zone, the film which is formed into a tube in this machine has an unbonded zone therein produced during the manufacture of the cross-laminate, e.g., by applying a strip of mold release agent to the film surface before the lamination process. A scored zone can be provided by scoring one layer with a cutting implement as the film unwinds from its roll before entering the tube-forming apparatus. The latter technique is advantageous in that in-process adjustments can be made by merely adjusting the cutting mechanism as appears to be indicated by control testing of the packages. For example, referring to FIG. 5, wherein like numerals are used to denote like elements to those shown in FIG. 2, a web 12 of film comprised of a cross-laminate of two layers 3 and 4 of oriented polyolefin can be moved continuously into a cylindrical tube-forming member 13, and one layer 3 of the cross-laminate film is scored, preferably substantially continuously, in the direction of the web's motion by contact with scoring means 14 as the web moves between cutting blades of scoring means 14 and back-up roller 15 toward the tube-forming member, whereby a tube is formed having two substantially longitudinal scored zones, i.e., linear cuts 8 and 9, in inside layer 3 of the cross-laminate film. Scored zones 8 and 9 in layer 3 are inclined to the orientation directions of layers 3 and 4 as shown in FIG. 2. The tube formed is sealed longitudinally to form seam 16, a water-bearing blasting agent is fed into the sealed tube through mandrel 17, the loaded tube is constricted at spaced intervals, a pair of encircling closure means 5 is applied to the constricted areas, and the tube is severed between the pair of closure means to form the separate cartridge 1. Apparatus for moving, sealing, end-closing, and severing the tube is described in the aforementioned U.S. Pat. No. 2,831,302. Alternatively, the scored zone(s) can be provided in the film during film manufacture operations prior to the winding of the film onto a roll.

We claim:

1. A blasting cartridge comprising a tube of plastic film gathered and closed at both ends and filled with a water-bearing blasting agent, said film comprising a cross-laminate of oriented film layers of like composition and pliability, said layers being adapted to fail in different directions along at least one unlaminated zone so as to rupture said cartridge upon the application of end pressure thereto in a borehole with a tamping rod, said unlaminated zone(s) being formed in said cross-laminate prior to or in conjunction with the application of end pressure to said cartridge.

2. A blasting cartridge of claim 1 wherein said film is a cross-laminate of two layers of oriented high-density polyolefin.

3. A blasting cartridge of claim 2 wherein said polyolefin is polyethylene.

4. A blasting cartridge of claim 2 wherein at least one of said layers has at least one scored zone along a major portion of the length of said cartridge, with the proviso that, when both of said layers have a scored zone, a scored zone in one layer is circumferentially offset from a scored zone in the other layer, each scored zone being inclined to the orientation of the layer adjacent thereto, and said cross-laminate being adapted to form said unlaminated zone(s) in situ upon the application of end pressure to said cartridge by delamination adjacent said scored zone(s).

5. A blasting cartridge of claim 4 wherein said scored zone(s) are present in only one of said layers, extend substantially the entire length of said cartridge, and are substantially parallel to the longitudinal axis of said tube.

6. A blasting cartridge of claim 5 wherin each scored zone is a single longitudinal cut.

7. A blasting cartridge of claim 6 having two closely spaced scored zones.

8. A blasting cartridge comprising a tube of plastic film gathered and closed at both ends and filled with a water-bearing blasting agent, said film comprising a cross-laminate of two layers of oriented high-density polyethylene, and one of said layers having at least one scored zone along a major portion of the length of said cartridge and inclined to the orientation of the layer adjacent thereto.

9. A blasting cartridge of claim 8 having two closely spaced scored zones, each scored zone being a single longitudinal cut.

10. In a method of continuously producing a series of chub cartridges by forming a web of film into a tube, longitudinally sealing the tube, feeding a water-bearing blasting agent into the tube, constricting the loaded tube at spaced intervals, applying a pair of encircling closure means to the constricted areas, and severing the tube between the pair of closure means, the improvement comprising continuously moving into a cylindrical tube-forming member a web of film comprised of a cross-laminate of two layers of oriented polyolefin of like composition and pliability, one layer of the cross-laminate film having at least one scored zone therein substantially in the direction of the web's motion as the web moves toward the tube-forming member, whereby a tube is formed from the cross-laminate film having at least one substantially longitudinal scored zone in one of the layers thereof inclined to the orientation of the other layer.

11. A method of claim 10 wherein the scored zone(s) are substantially continuous linear cuts, and the layer scored forms the inside layer of the tube formed.

12. A method of claim 10 wherein as the cross-laminate film moves toward the tube-forming member one of the layers thereof is contacted by scoring means whereby said scored zone(s) are formed.

13. A blasting cartridge comprising a tube of plastic film gathered and closed at both ends and filled with a water-bearing blasting agent, said film comprising a cross-laminate of oriented film layers of like composition and pliability, and said cross-laminate having at least one unlaminated zone along a major portion of the length of said cartridge, whereby said layers fail in different directions along said unlaminated zone and said cartridge ruptures upon the application of end pressure thereto in a borehole with a tamping rod.

* * * * *